US007066834B2

(12) United States Patent
Yamamoto

(10) Patent No.: US 7,066,834 B2
(45) Date of Patent: Jun. 27, 2006

(54) IRON TYPE GOLF CLUB HEAD

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 159 days.

(21) Appl. No.: 10/650,926

(22) Filed: Aug. 29, 2003

(65) Prior Publication Data

US 2005/0049079 A1 Mar. 3, 2005

(30) Foreign Application Priority Data

Aug. 30, 2002 (JP) ..... P2002-254777

(51) Int. Cl.
*A63B 53/04* (2006.01)
*A63B 53/06* (2006.01)

(52) U.S. Cl. ..... 473/342; 473/350

(58) Field of Classification Search ..... 473/324–350
See application file for complete search history.

(56) References Cited

U.S. PATENT DOCUMENTS 3,955,820 A * 5/1976 Cochran et al. ..... 473/337
4,398,965 A * 8/1983 Campau ..... 148/522
4,420,156 A * 12/1983 Campau ..... 473/291
4,792,139 A * 12/1988 Nagasaki et al. ..... 473/342
4,884,812 A * 12/1989 Nagasaki et al. ..... 473/342
5,011,151 A * 4/1991 Antonious ..... 473/242
5,433,440 A * 7/1995 Lin ..... 473/342
5,486,000 A * 1/1996 Chorne ..... 473/350
5,601,501 A * 2/1997 Kobayashi ..... 473/350
5,643,103 A * 7/1997 Aizawa ..... 473/290
5,683,310 A * 11/1997 Chen ..... 473/349
5,697,855 A * 12/1997 Aizawa ..... 473/350
5,735,755 A * 4/1998 Kobayashi ..... 473/342
5,871,408 A * 2/1999 Chen ..... 473/409
5,899,820 A * 5/1999 Minematsu et al. ..... 473/329
5,916,041 A * 6/1999 Antonious ..... 473/328
5,967,903 A * 10/1999 Cheng ..... 473/342
5,976,029 A * 11/1999 Sherwood ..... 473/291
6,001,032 A * 12/1999 Onuki et al. ..... 473/342
6,196,934 B1 * 3/2001 Sherwood ..... 473/290
6,344,000 B1 * 2/2002 Hamada et al. ..... 473/329
6,517,448 B1 * 2/2003 Takeda ..... 473/324
6,530,846 B1 * 3/2003 Mase ..... 473/290
6,709,345 B1 * 3/2004 Iwata et al. ..... 473/291
6,852,041 B1 * 2/2005 Huang ..... 473/342

* cited by examiner

*Primary Examiner*—Eugene Kim
*Assistant Examiner*—Alvin A. Hunter, Jr.
(74) *Attorney, Agent, or Firm*—Birch Stewart Kolasch & Birch LLP

(57) ABSTRACT

An iron type golf club head comprising: a face plate provided with face grooves; and a head main body arranging the face plate on a front surface thereof, wherein the face plate comprises a peripheral edge part firmly fixed to the head main body, and a non-supported part forming an area surrounded by the peripheral edge part and having a back surface apart from the head main body, and the non-supported part satisfies the following equations (1), (2) and (3):

$$1.1 \leqq ha/hb \leqq 1.6; \quad (1)$$

$$1.1 \times (ha+hb)/2 \leqq hc \leqq 1.5 \times (ha+hb)/2; \quad (2)$$

$$18\ (\mathrm{mm}) \leqq \mathrm{hb} \leqq 38\ (\mathrm{mm}) \quad (3)$$

(in which ha is a toe side height (mm) of the face groove in an end portion closest to the toe side, hb is a heel side height (mm) of the face groove in an end portion closest to the heel side, and hc is an intermediate height (mm) of the face groove in an intermediate position between the end portion on the toe side and the end portion on the heel side).

9 Claims, 6 Drawing Sheets

IRON TYPE GOLF CLUB HEAD

This nonprovisional application claims priority under 35 U.S.C. § 119(a) on Patent Application No(s). 2002-254777 filed in JAPAN on Aug. 30, 2002, which is(are) herein incorporated by reference.

BACKGROUND OF THE INVENTION

1. Field of the Invention

The present invention relates to an iron type golf club head capable of improving a repulsion performance.

2. Description of the Related Art

In a golf game, it is advantageous that a ball travels far. For example, in an iron type golf club, it is possible to have a clear shot to the green by a club of a high number having a large loft angle. The club of the high number has a high trajectory, the ball tends to stop on the green, and a lateral deflection is a little. Accordingly, a score is improved.

In conventional, in order to increase a carry of the iron type golf club, a repulsion performance of the head is improved. In particular, there has been known methods of making a thickness of a face entirely thin, and of forming grooves or the like in a peripheral portion of the face. These methods deflect largely the face at a time of hitting the ball. However, in the head mentioned above, there is a case that a durability is deteriorated by making the face thin, and an effect of improving the repulsion performance is not enough.

Further, as shown in FIG. 7A and FIG. 7B showing a cross section taken along line A—A in FIG. 7A, there has been known a head "a" structured by a face plate "b" and a head main body "c" arranging the face plate "b" on a front surface thereof. The head main body "c" has an opening "d" extending back and forth. The face plate "b" comprises a non-supported part "e" in which a back surface is faced to the opening "d". Since the non-supported part "e" is not clamped to the head main body "c", it is useful for largely deflecting the face plate "b" at a time of hitting the ball.

In this case, a general ball hitting position P (shown in FIG. 7A) of the iron type golf club is normally concentrated on an approximately intermediate position between an end portion Et on a toe side of a face groove f formed on the face surface and an end portion Eh on a heel side, or on a slightly heel side position. Accordingly, in order to improve a head repulsion performance, it is desirable that a portion near the ball hitting position P is deflected at maximum.

However, as shown in FIG. 7C showing a rear view of a conventional iron type golf club head, a height "h" of the non-supported part "e" gradually becomes larger from the heel side toward the toe side. The non-supported part "e" can not make the deflection near the ball hitting position P larger. Therefore, in order to improve the repulsion performance of the head, there is further room for improvement.

SUMMARY OF THE INVENTION

The present invention is made in view of the above circumstances, and an object of the present invention is to provide an iron type golf club head capable of improving a repulsion performance of a ball hitting point frequently hitting the ball, and carrying the ball far.

In accordance with the present invention, there is provided an iron type golf club head comprising: a face plate provided with face grooves; and a head main body arranging the face plate on a front surface thereof, wherein the face plate includes a peripheral edge part firmly fixed to the head main body, and a non-supported part forming an area surrounded by the peripheral edge part and having a back surface apart from the head main body, and the non-supported part satisfies the following equations (1), (2) and (3):

$$1.1 \leqq ha/hb \leqq 1.6 \quad (1);$$

$$1.1 \times (ha+hb)/2 \leqq hc \leqq 1.5 \times (ha+hb)/2 \quad (2);$$

$$18\ (\mathrm{mm}) \leqq \mathrm{hb} \leqq 38\ (\mathrm{mm}) \quad (3)$$

(in which ha is a toe side height (mm) of the face groove in an end portion closest to the toe side, hb is a heel side height (mm) of the face groove in an end portion closest to the heel side, and hc is an intermediate height (mm) of the face groove in an intermediate position between the end portion on the toe side and the end portion on the heel side).

It is desirable that, a length D along the face groove between the end portion on the toe side and the end portion on the heel side is 1.2 to 2.2 times the intermediate height hc. Further, it is desirable that a dead weight member having a large specific gravity is firmly fixed to the head main body on the toe side when viewed from the intermediate position.

DESCRIPTION OF THE PREFERRED EMBODIMENTS

Hereinafter, description will be given of an embodiment in accordance with the present invention with reference to the accompanying drawings.

Figure 1:
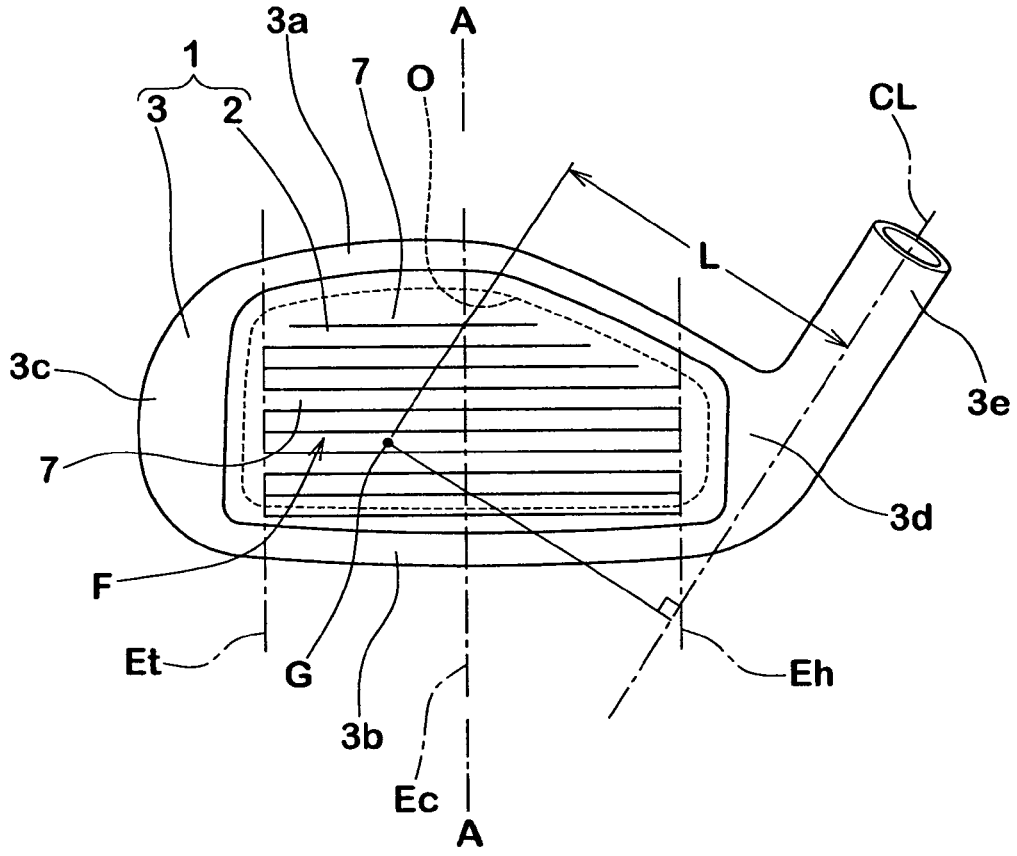
FIG. 1 is a front view of an iron type golf club head showing an embodiment in accordance with the present invention.

FIG. 1 is a front view showing an embodiment of an iron type golf club head in accordance with the present invention in a state that a face surface is vertically risen up. An iron type golf club head (hereinafter, simply referred to as "head" in some cases) 1 in accordance with the present embodiment comprises a face plate 2 having a face surface F hitting a ball, and a head main body 3 arranging the face plate 2 on a front surface thereof.

The head main body 3 is formed by a metal material having a comparatively large specific gravity such as a stainless steel (for example, SUS630) or the like in the present embodiment. Further, the head main body 3 herein comprises a top portion 3*a* forming a head upper portion, a sole portion 3*b* forming a head lower portion, a toe portion 3*c* jointing between the top portion 3*a* and the sole portion 3*b*, a neck portion 3*d* jointing between the top portion 3*a* and the sole portion 3*b* on a heel side of the head, and a tubular shaft mounting portion 3*e* extending upward from the neck portion 3*d*.

Figure 2:
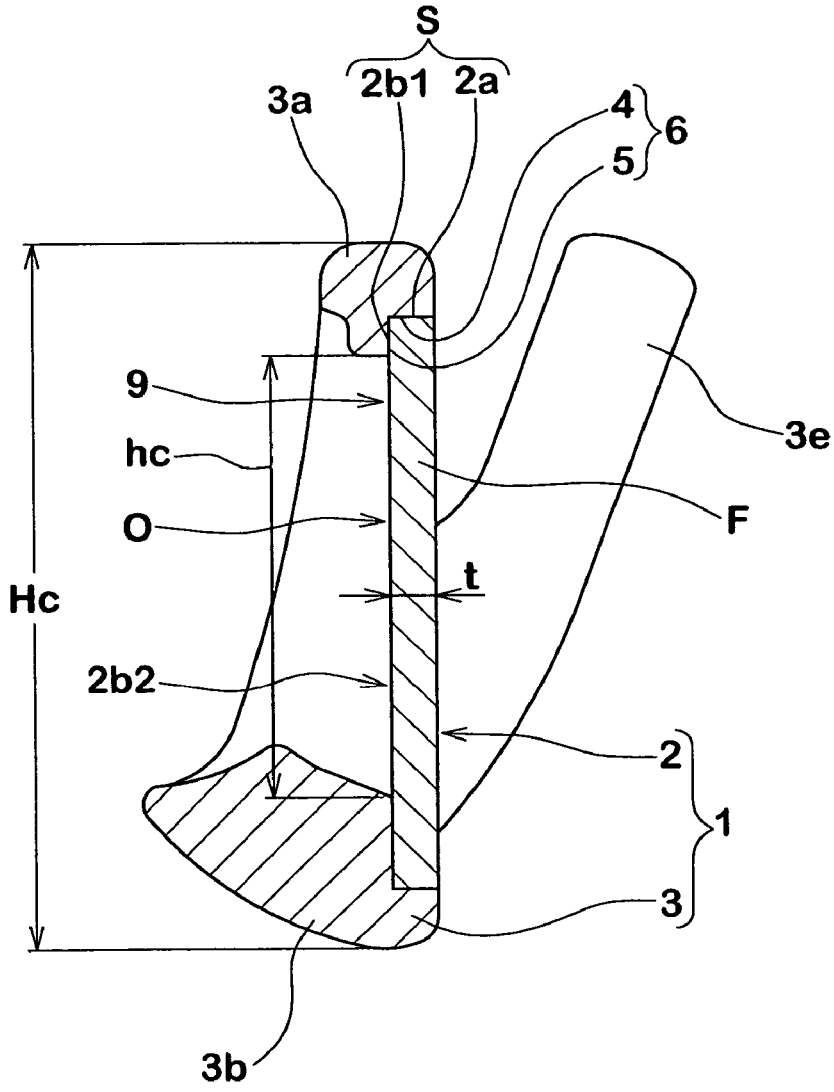
FIG. 2 is an end surface view taken along line A—A in FIG. 1.
Figure 3:
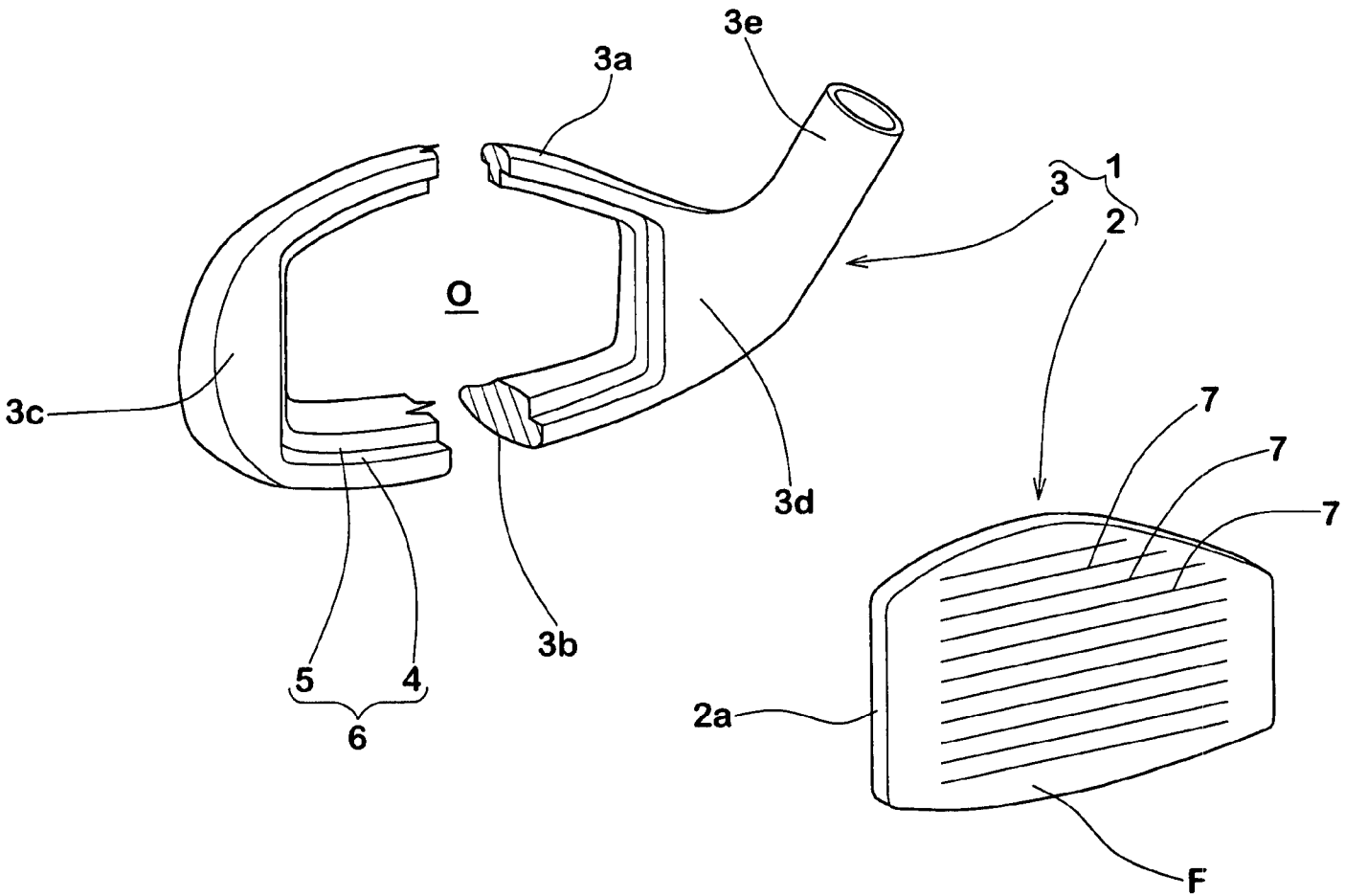
FIG. 3 is an exploded perspective view of FIG. 1.

Further, as shown in FIGS. 2 and 3, the head main body 3 is provided with an opening O surrounded by the top portion 3*a*, toe portion 3*c*, sole portion 3*b* and neck portion 3*d*. The opening O extends back and forth through the head main body 3. A profile shape of the opening O is not particularly limited, however, is determined so as to satisfy rules about a height of a non-supported part 9 (mentioned below) of the face plate 2. As shown in FIG. 3, the opening O of the present embodiment has a structure that edge portions on the toe side and the heel side are formed in a linear shape extending vertically. However, this portion may be smoothly formed by a circular arc curve.

A face mounting portion 6 firmly fixed to a peripheral edge part S of the face plate 2 is formed in a periphery of the opening O. The face mounting portion 6 of the present embodiment comprises an inner peripheral surface 4 facing to an outer peripheral end surface 2*a* of the face plate 2, and a support surface 5 facing to a peripheral edge back surface 2*b*1 of the face plate 2, and is shown as the face mounting portion having a step-shaped cross section. The support surface 5 is shown as the support surface formed with an approximately fixed width in the present embodiment. However, the width may be differentiated in the respective portions. The face mounting portion 6 is annularly connected to a periphery of the opening O.

The face plate 2 is structured as a plate having an outer peripheral end surface 2*a* of a profile shape which is closely fitted to the inward surface 4 of the face mounting portion 6. Further, the face plate 2 is formed by a different material from that of the head main body 3. The face plate 2 of the present embodiment is formed by a metal material having a specific gravity smaller than that of the head main body 3, for example, a titanium alloy, an aluminum, an aluminum alloy, a magnesium alloy or a fiber reinforced resin. In the case that the face plate 2 is formed by the metal material having the specific gravity smaller than that of the head main body 3, a weight of the head is more distributed to a peripheral portion of the face surface F, so that a sweet area is increased.

Further, in the face plate 2, a plurality of face grooves 7 are provided on the face surface F forming the ball hitting surface with an interval in a direction of a face height. The face grooves 7 extend approximately horizontally in a toe and heel direction in a head measurement state that the head is grounded on a horizontal surface by a specified lie angle and loft angle in the present embodiment. The face groove 7 in accordance with the present embodiment is shown as the face groove which is continuously provided in a horizontal direction, however, may have a discontinuous portion in the middle. Further, the face grooves 7 improve a friction between the face surface F and the ball, and increase a backspin amount of the ball. A cross sectional shape of the face grooves 7 can employ various shapes such as a triangular shape, a rectangular groove shape and the like. Further, the face groove is defined in a golf rule of Japan Golf Association about a groove width, a groove depth and an interval between the grooves. The face grooves 7 in accordance with the present embodiment satisfy this rule.

Further, the face grooves 7 impress the golfer with a substantially effective ball hitting area particularly in the toe and heel directions. Accordingly, most of the golfers try to hit the ball at least by a portion between an end portion Et of the face grooves 7 closest to the toe side and an end portion Eh closest to the heel side, in particular, a portion near an intermediate position Ec between the end portion Et on the toe side and the end portion Eh on the heel side.

Figure 6:
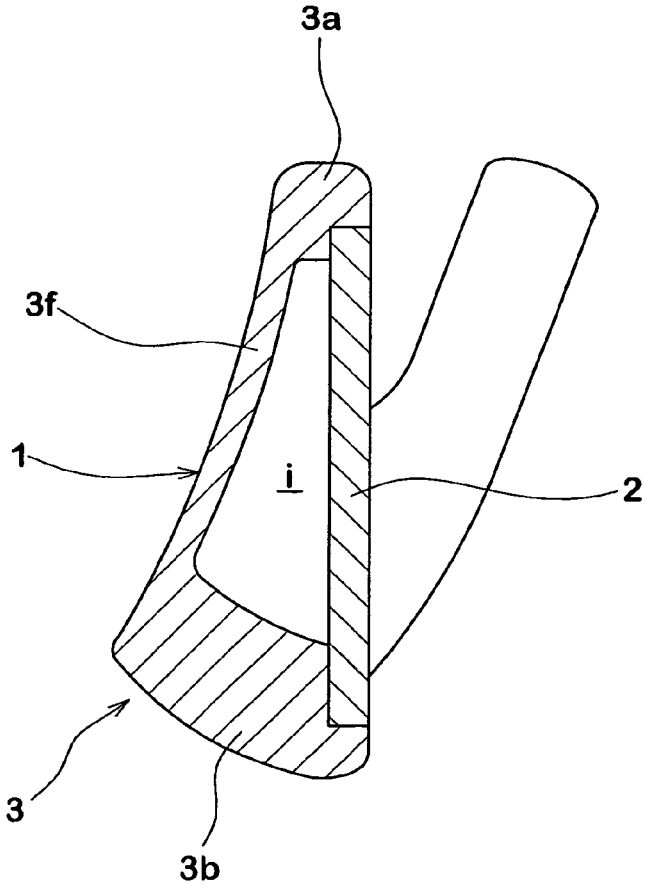
FIG. 6 is a cross-sectional view showing another embodiment in accordance with the present invention.
Figure 7A:
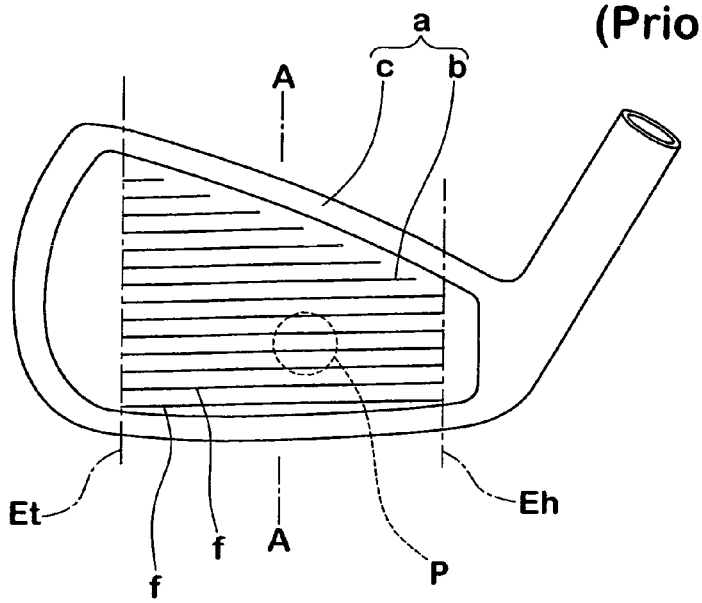
FIG.7(A) (Prior Art)
FIG. 7A is a front view showing a conventional head.
Figure 7B:
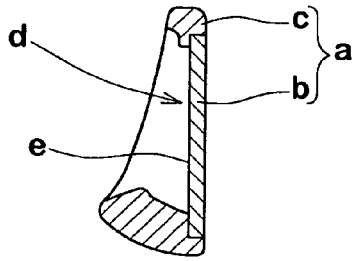
FIG. 7B is a cross-sectional view taken along line A—A in FIG. 7A
Figure 7C:
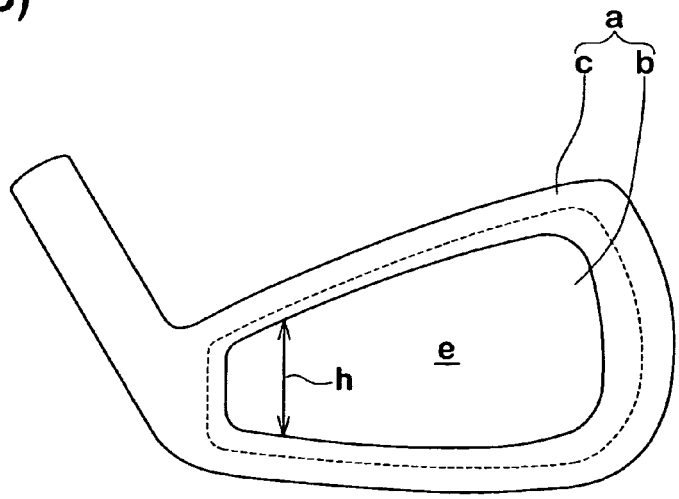
FIG. 7C is a rear view of FIG. 1.

Further, the face plate 2 is integrally fixed to the face mounting portion 6 of the head main body 3 by bonding means, for example, a caulking, a adhesion, a brazing, a welding if it is possible or the like. Accordingly, the a non-supported part 9 forming an area surrounded by a peripheral edge part S of the face plate 2 and apart from the head main body 3 in a back surface 2*b*2 is formed in the face plate 2. The non-supported part 9 is structured such that it is not in contact with the head main body 3 not only in a static state but also in a bent time by hitting the ball. In the present embodiment, there is shown a structure in which the non-supported part 9 is provided by forming the opening O penetrating back and forth in the head main body 3. However, for example, as shown in FIG. 6, the head main body 3 may be structured such that a back wall portion 3*f* is provided in a position apart from the back surface of the face plate 2, and a hollow i is interposed between the back wall portion and the face plate 2, whereby the non-supported part 9 may be formed.

A thickness t (a thickness at a position except for the face groove 7) of the non-supported part 9 can be variously set in correspondence to a strength of the employed material. However, when the thickness is too small, a durability tends to be deteriorated, and when it is too large, a rigidity is excessively increased and a repulsion performance tends to be lowered. In accordance with the point of view mentioned above, it is desirable that the thickness t is set, for example, between 2.0 and 3.3 mm, more preferably between 2.5 and 3.0 mm. Further, in accordance with the present embodiment, there is shown the structure in which the non-supported part 9 of the face plate 2 is formed with a substantially fixed thickness t. However, in addition to this, it is possible to carry out various aspects, for example, a small thickness portion is provided in a peripheral edge part of the non-supported part 9, a recess grove along the opening O may be provided, the thickness is changed step by step, and the like (not shown).

Figure 4:
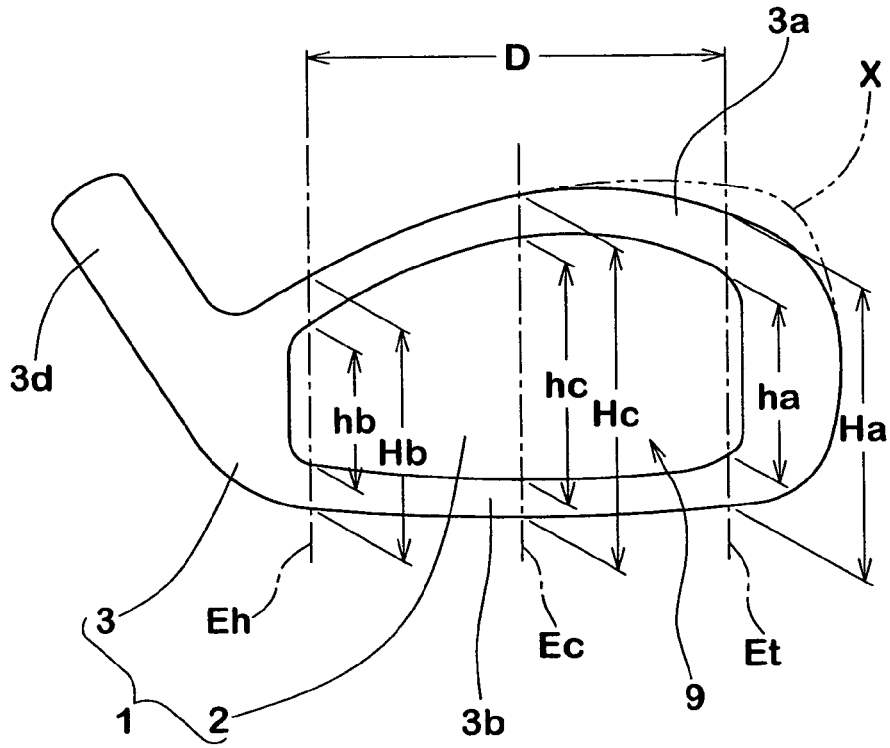
FIG. 4 is a rear view of FIG. 1.

The head 1 in accordance with the present invention is improved from the conventional head with respect to the shape of the non-supported part 9. In other words, one of features of the non-supported part 9 is to satisfy the following equations (1) to (3) as shown in FIGS. 1 and 4:

$$1.1 \leqq ha/hb \leqq 1.6 \quad (1);$$

$$1.1 \times (ha+hb)/2 \leqq hc \leqq 1.5 \times (ha+hb)/2 \quad (2);$$

$$18\ (\mathrm{mm}) \leqq \mathrm{hb} \leqq 38\ (\mathrm{mm}) \quad (3)$$

(in which ha is a toe side height (mm) of the face groove in the end portion Et closest to the toe side, hb is a heel side height (mm) of the face groove in the end portion Eh closest to the heel side, and hc is an intermediate height (mm) of the face groove in an intermediate position Ec between the end portion Et on the toe side and the end portion Eh on the heel side). Further, each of the heights ha, hb and hc is measured in a direction perpendicular to the face groove 7 along the face surface F, as representatively shown by "height hc" in FIG. 2.

In the conventional this kinds of iron type golf club head, the height ratio (ha/hb) defined by the equation (1) is approximately larger than 1.6, and is particularly set to be equal to or more than 2.0. In other words, the heel side height hb of the non-supported part 9 is very small in comparison with the toe side height ha. On the assumption that the non-supported part 9 is both end fixed beam supported by both ends between the top portion 3*a* of the head main body 3 and the sole portion 3*b*, in the case that the same load is vertically applied to the non-supported part 9, the larger a span of the beam is, the larger the maximum deflection amount becomes. Therefore, in the conventional head, it is hard to secure a sufficiently large deflection in the heel side of the non-supported part 9.

In accordance with the present invention, on the basis of the equation (1), the ratio (ha/hb) between the toe side height ha of the non-supported part 9 and the heel side height hb is setted between 1.1 and 1.6. Accordingly, it is possible to enlarge the heel side height hb with respect to the toe side height ha of the non-supported part 9 in comparison with the conventional height, and it is possible to secure a great deflection even in the heel side of the non-supported part 9. Herein, when the ratio (ha/hb) is less than 1.1, the toe side height ha of the non-supported part 9 becomes relatively excessively small. This tends to make a distance L of a center of gravity corresponding to a minimum distance between a center of gravity G of the head and a shaft axis (an axial center line CL of a shaft insertion hole in the shaft mounting portion 3*d*) small, as shown in FIG. 1. When the gravity center distance L becomes small, the face surface F of the head 1 excessively turns back during the swing, and a ball catch tends to be generated (in the case of a right-handed golfer, the hit ball tends to deflect leftward). On the contrary, when the ratio (ha/hb) exceeds 1.6, it is impossible to sufficiently achieve an effect of improving the deflection in the heed side portion of the non-supported part 9. In accordance with these view points, it is particularly preferable to set the ratio (ha/hb) between 1.2 and 1.5, and further preferably between 1.3 and 1.4.

Further, in the equation (3), the heel side height hb of the non-supported part 9 is setted to 18 to 38 mm, and preferably between 18 and 35 mm. This is because the effect of improving the repulsion performance can not be sufficiently obtained even by defining the ratio (ha/hb), in the case that the heel side height hb is less than 18 mm. On the contrary, when the heel side height hb exceeds 38 mm, the gravity center distance L tends to be significantly made small, and a direction stability of the hit ball is lowered. It is particularly preferable to set the heel side height hb in correspondence to the loft angle of the head. For example, in the case that the head 1 is used for number 3 to 5 irons (about 20 to 26° of loft angle), it is desirable to set the heel side height hb between 18 and 29 mm. In the case that the head 1 is for number 6 to 8 irons (about 27 to 36° of loft angle), it is desirable to set the heel side height hb between 19 and 30 mm. In the case that the head 1 is used for a high number such as a number 9 or subsequent irons (about 37° or more of loft angle), it is desirable to set the heel side height hb between 22 and 35 mm.

Further, in accordance with the present invention, in the equation (2), the intermediate height hc of the non-supported part 9 is setted. The intermediate height hc is set to 1.1 to 1.5 times an average height {(ha+hb)/2} between the toe side height ha and the heel side height hb. When the intermediate height hc is less than 1.1 times the average height, it is hard to secure a great deflection near the intermediate position Ec of the non-supported part 9. On the contrary, when it exceeds 1.5 times, the shape of the head is greatly changed from the conventional one, the uncomfortable feeling tends to be generated at a time of coming to the ready. It is particularly preferable to set the intermediate height hc of the non-supported part to 1.2 to 1.4 times the average height {(ha+hb)/2}, and it is further preferable to set it to 1.3 to 1.4 times. In this case, it is possible to provide a head having a more improved repulsion performance of the ball hitting position and a particularly excellent repulsion performance, by making the intermediate height hc larger than the toe side height ha of the non-supported part 9 (ha<hc). Herein, in the profile shape of the non-supported part 9, since the sole side is formed approximately flat in the present embodiment, there is shown as the shape in which the top portion side has a chevron shape.

Further, a length D along the face groove 7 between the toe side end portion Et of the face groove 7 and the heel side end portion Eh is not particularly limited. However, when it is too small, the effect of improving the repulsion performance of the head can not sufficiently obtained. On the contrary, when it is too large, the gravity center distance L becomes too large and the turn-back of the head tends to be deteriorated. In accordance with these view points, it is desirable that the length D is set to 1.2 to 2.2 times the intermediate height hc of the non-supported part 9, and it is more preferable that it is set to 1.2 to 2.0 times.

Figure 5:
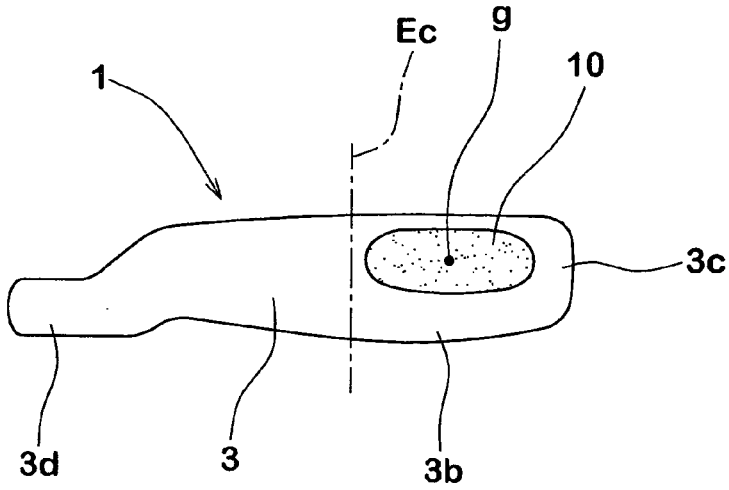
FIG. 5 is a bottom view of a head.

Further, in the head 1 as the present embodiment, since the respective heights hc and hb are enlarged in the intermediate position Ec and the heel side end portion Eh of the non-supported part 9, the head gravity center G tends to be close to the heel side and the gravity center distance L tends to be small as mentioned above. Therefore, for example, as shown in FIG. 5, it is desirable to firmly fix a dead weight member 10 having a large specific gravity to the toe side rather than the intermediate position Ec of the head main body 3 so as to optimize the position of the head gravity center G. In this case, the "toe side when viewed from the intermediate position Ec" means that a center of gravity g of the dead weight member 10 is positioned close to the toe side in comparison with the intermediate position Ec. Further, the dead weight member having the large specific gravity means that the specific gravity of the dead weight member 10 is larger than the specific gravity of the constituting members of the head main body 3 except for the dead weight member 10. The dead weight member 10 can preferably employs a tungsten, a tungsten alloy, a copper alloy and the like. For example, it is desirable that the specific gravity is equal to or more than 8.0, and it is desirable to arrange the dead weight member in the sole portion 3*b* as shown in FIG. 5.

Further, although the gravity center distance L is not particularly limited, the gravity center distance L is desirably set between 38 and 42 mm in the case that the head 1 is used for the number 3 to 5 irons (about 20 to 26° of the loft angle), between 37 and 41 mm in the case that the head 1 is used for the number 6 to 8 irons (about 27 to 36° of the loft angle), and between about 35.5 and 39.5 mm in the case that the head 1 is used for the high number such as a number 9 or subsequent irons (37 or more degree of the loft angle). In the same manner, in a state of measuring the head, it is desirable to set the gravity center height corresponding to the height of the head gravity center G from the horizontal surface to about 19.5 to 23.0 mm.

The head main body 3 in accordance with the present embodiment has a structure in which the top portion 3*a* has a profile shape along the non-supported part 9. In particular, as shown in FIG. 4, respective heights Ha, Hb and Hc from the sole portion 3*b* to the top portion 3*a* satisfy the following equation (4) to (6) in the respective positions comprising the toe side end portion Et of the face groove 7, the heel side end portion Eh and the intermediate position Ec (in this case, each of the heights Ha to Hc is measured in the perpendicular direction to the face groove 7 along the face surface F, as the height Hc is representatively shown in FIG. 2).

$$1.1 \leqq Ha/Hb \leqq 1.6 \quad (4)$$

$$1.1 \times (Ha+Hb)/2 \leqq Hc \leqq 1.5 \times (Ha+Hb)/2 \quad (5)$$

$$Hc > Ha \quad (6)$$

Herein, as shown by a phantom line X in FIG. 4, the top portion 3*a* of the head main body 3 may be made similar to the conventional profile shape.

EXAMPLES

Each of iron type golf club heads shown in Table 1 was manufactured by way of trial by integrally caulking a face plate made of a titanium alloy (Ti-6Al-4V) press material with a head main body made of a SUS630 lost wax casted cast material. A shape of the head main body was based on FIG. 1. Further, a repulsion performance of the head simple substance was searched. The same shaft was attached to each of the heads, and a ball hitting test was executed. Further, the same test was applied also to comparative examples. A general specification of the heads is as follows.

Loft angle (real loft angle): 26° (number 5 iron)

Thickness of face plate: 3.0 mm (uniform except for face groove)

Length D between toe side end portion of face groove and heel side end portion: 56 mm Head weight: 249 g Heel side height hb of non-supported part: 20 mm Further, the testing method is as follows.

<Repulsion Performance>

The repulsion performance of the head was obtained by calculating the repulsion coefficient on the basis of Procedure for Measuring the Velocity Ratio of a Club Head for Conformance to Rule 4-1e, Revision 2 (Feb. 8, 1999) in U.S.G.A. The larger numerical value is better.

<Ball Hitting Test>

The same shaft was attached to each of the trial heads, each of ten right-handed average golfers (having handicap between 15 and 30) hits ten balls by using each of the clubs, and a directionality of the ball drop position was checked with respect to a target direction.

Results of test are shown in Table 1.

TABLE 1

| | | Comparative Example 1 | Comparative Example 2 | Example 1 | Example 2 | Example 3 |
|---|---|---|---|---|---|---|
| Specification of non-supported part | (ha/hb) | 1.2 | 1.0 | 1.3 | 1.5 | 1.3 |
| | 2hc/(ha + hb) | 1.0 | 1.3 | 1.3 | 1.3 | 1.4 |
| | hb [mm] | 20 | 20 | 20 | 20 | 20 |
| | D [mm] | 56 | 56 | 56 | 56 | 56 |
| Gravity center distance L [mm] | | 40 | 37 | 40 | 40 | 40 |
| Gravity center height [mm] | | 20.0 | 21.5 | 20.0 | 20.0 | 20.0 |
| Test result | Repulsion coefficient | 0.780 | 0.810 | 0.805 | 0.810 | 0.819 |
| | Ball hitting test (directionality) | Good | Caught leftward | Good | Good | Good |

As a result of the test, it is known that the structures in accordance with the examples are improved in the repulsion performance in comparison with the comparative examples. Further, the directionality of the hit ball is stable, and it is possible to confirm an advantage against the comparative examples.

As described above, in the iron type golf club head in accordance with the present invention, since the non-supported part facing to the opening of the head main body is provided on the back surface of the face plate, and the toe side height ha of the non-supported part, the heel side height hb and the intermediate height hc are limited, it is possible to secure the large deflection of the standard ball hitting position so as to improve the repulsion performance.

Further, when the length D between the toe side end portion of the face groove and the heel side end portion is regulated to the fixed range, as described in the present invention, it is possible to adjust the gravity center distance of the head and it is useful for stabilizing the directionality of the hit ball.

Further, when the dead weight member having the large specific gravity is firmly fixed to the head main body in the toe side rather than the intermediate position, as described in the present invention, it is possible to arrange a sufficient weight in the toe side, and it is possible to effectively prevent the gravity center distance of the head from becoming significantly small.

What is claimed is:

1. An iron type golf club head comprising:

a face plate provided with face grooves; and a head main body arranging the face plate on a front surface thereof, wherein the face plate comprises a peripheral edge part firmly fixed to the head main body, and a non-supported part forming an area surrounded by the peripheral edge part and having a back surface apart from the head main body, the non-supported part having a profile shape which comprises:

a toe side edge extending substantially vertically on a toe portion, a heel side edge extending substantially vertically on a heel portion, a sole side edge between the toe side edge and the heel side edge on a sole portion extending substantially horizontally, and a top side edge between the toe side edge and the heel side edge on a top portion extending in a chevron shape, and the non-supported part satisfies the following equations (1), (2), and (3):

$$1.1 \leqq ha/hb \leqq 1.6 \quad (1);$$

$$1.1 \times (ha+hb)/2 \leqq hc \leqq 1.5 \times (ha+hb)/2 \quad (2);$$

$$18(\text{mm}) \leqq hb \leqq 38\ (\text{mm}) \quad (3)$$

(in which ha is a toe side height (mm) of the non-supported part at a position of an end portion of the face groove closest to the toe side, hb is a heel side height (mm) of the non-supported part at a portion of an end portion of the face groove closest to the heel side, and hc is an intermediate height (mm) of the non-supported portion at an intermediate position between the end portion on the toe side and the end portion on the heel side).

2. The iron type golf club head according to claim 1, wherein a length D along the face groove between the end portion on the toe side and the end portion on the heel side is 1.2 to 2.2 times the intermediate height hc.

3. The iron type golf club head according to claim 1 or 2, wherein a dead weight member having a large specific gravity is firmly fixed to the head main body on the toe side when viewed from the intermediate position.

4. The iron type golf club head according to claim 1, wherein the head main body has an opening penetrating back and forth.

5. The iron type golf club head according to claim 1, wherein the following equation is satisfied:

$$ha<hc.$$

6. The iron type golf club head according to claim 1, wherein the head main body satisfies the following equations (4), (5) and (6):

$$1.1<Ha/Hb<1.6 \quad (4);$$

$$1.1\times(Ha+Hb)/2\leqq Hc\leqq 1.5\times(Ha+Hb)/2 \quad (5);$$

$$Hc>Ha \quad (6)$$

(in which Ha is a toe side height (mm) of the head main body in the end portion on the toe side, Hb is a heel side height (mm) of the head main body in an end portion on the heel side, and Hc is an intermediate height (mm) of the head main body in an intermediate position between the toe side end portion and the heel side end portion).

7. The iron type golf club head according to the claim 1, wherein a height of the non-supported part of the face plate gradually increases from the heel side height to the intermediate height and gradually decreases from the intermediate height to the toe side height.

8. The iron type golf club head according to the claim 1, wherein the head main body comprises a support surface facing and supporting the peripheral edge part of the face plate, and the support surface is formed as approximately fixed width and continues annularly.

9. The iron type golf club head according to claim 1, wherein a gravity of center distance is at least 35.5mm to at most 42mm from a hosel in a plane perpendicular to the centerline of the hosel.

* * * * *